United States Patent [19]

Sjöbom

[11] Patent Number: 4,610,400

[45] Date of Patent: Sep. 9, 1986

[54] DEVICE AT REFINERS FOR LIGNOCELLULOSE-CONTAINING MATERIAL

[75] Inventor: Axel H. Sjöbom, Bellevue, Wash.

[73] Assignee: Sunds Defibrator Aktiebolag, Sundsvall, Sweden

[21] Appl. No.: 681,869

[22] PCT Filed: Apr. 3, 1984

[86] PCT No.: PCT/SE84/00119

§ 371 Date: Nov. 19, 1984

§ 102(e) Date: Nov. 19, 1984

[87] PCT Pub. No.: WO84/04057

PCT Pub. Date: Oct. 25, 1984

[30] Foreign Application Priority Data

Apr. 12, 1983 [SE] Sweden ..... 8302013

[51] Int. Cl.[4] ..... B02C 7/12

[52] U.S. Cl. ..... 241/261.2; 241/298

[58] Field of Search ..... 241/261.2, 261.3, 296, 241/297, 298

[56] References Cited

U.S. PATENT DOCUMENTS 4,023,737 5/1977 Leider et al. ..... 241/298 X 4,355,768 10/1982 Johansson ..... 241/298 X

*Primary Examiner*—Mark Rosenbaum

*Attorney, Agent, or Firm*—Burns, Doane, Swecker & Mathis

[57] ABSTRACT

A refiner comprising a disc-shaped carrier (11,12,31,32) provided with refiner segments (20,21,41,42) in a ring extending all about. The refiner segments are retained on the carrier by cams (22) and grooves (23) which keyingly engage with each other. Each refiner segment (20,21,41,42) further is locked individually on the carrier (11,12,31,32) by means of a separate movable locking member (24), which is located in the carrier and co-operates with a recess (25,47,52) in the rear surface of the refiner segment.

5 Claims, 12 Drawing Figures

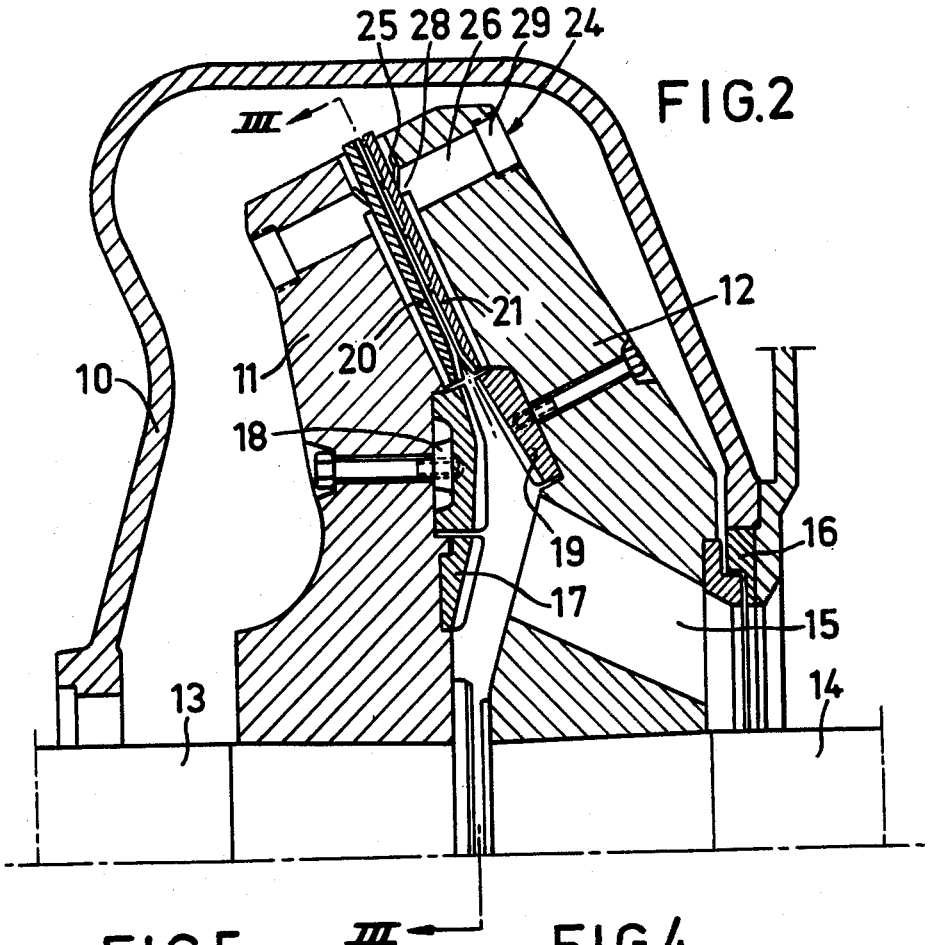
FIG.2
FIG.5
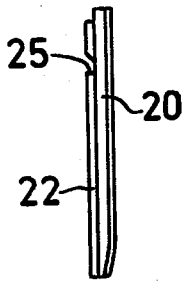
FIG.4
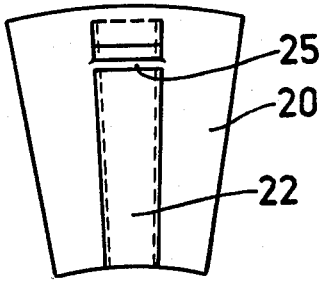
FIG.6
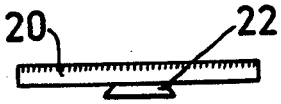

DEVICE AT REFINERS FOR LIGNOCELLULOSE-CONTAINING MATERIAL

BACKGROUND AND SUMMARY OF THE INVENTION

This invention relates to refiner members for refiners for lignocellulose-containing fibrous, preferably vegetable material, which members comprise a carrier and connected thereto at least one ring of segments of a hard material which form the refining surface of said member.

According to a usual design, the refining members are discs, on which one or more rings of segments are attached about the radial lateral surface of the disc-shaped carrier. The refiner comprises at least one pair of discs, which are rotatable relative to and maintained with pressure against each other. In the gap formed between the discs, the material to be refined, for example wood chips, is disintegrated to fibre pulp. The gap is defined by segments, the surfaces of which facing toward each other are formed with elevations in the form of grooves and, respectively, bars or the like, the object of which is to promote the processing of the material in order to expose fibres and, respectively, fibrils. In modern refiners the rotary disc rotates at a high speed and has a great diameter, and the segments, therefore, are subjected to very high centrifugal forces. As an example can be mentioned, that at segments with a weight of some tens of kilos centrifugal forces of the magnitude 50 Mp can arise.

The segments normally are attached on the disc-shaped carrier or holder of the refiner disc by means of bolts, which are screwn into the segments from the rear side thereof. In view of the very high stresses, a plurality of bolts are used for each segment, but the stresses arising in the segments proper yet are so high, that the segments must be designed with a thickness, and thereby with a weight, which by far exceeds what is required for forming the grooves and bars therein. In addition, in order to obtain the highest possible wear resistance, the segments must be manufactured of a very hard material, which from a strength point of view cannot be calculated safely. The segments, thus, have been overdimensioned to a high degree. This additionally increases the stresses in the segments and attachment bolts. Owing to their great thickness, the segments by action of the centrifugal forces also are subjected about their outer periphery to a high torque, which tends to swing the segments out from the carrier.

At another embodiment, the segments are attached on the carrier by means of keyingly interengaging grooves and bars and an overall locking ring, which takes up the centrifugal forces acting on the segments. This implies that each segment behind its processing surface can be designed less thick than required at the use of bolts. Hereby the centrifugal forces and, thus, the stresses are reduced.

Such a design, however, renders exchange of one or more segments difficult. The refiner must be taken out of operation for a reletively long time, because the entire locking ring must be dismantled. This design further requires a very high precision of the outer diameter of the segments, because each segment must be connected to the carrier by the locking ring with no clearance at all.

The present invention solves the aforesaid problems and renders possible a substantially simplified attachment of the disc segments on the carrier by means of separate locking members without jeopardizing the operation reliability. The segments thereby can be exchanged much more rapidly and simply, and at the same time the manufacturing costs of the segments can be reduced.

BRIEF DESCRIPTION OF THE DRAWINGS

The invention is described in greater detail in the following, with reference to the embodiments shown in the accompanying drawings, in which FIG. 2 shows an alternative embodiment of the device shown in FIG. 1.

DETAILED DESCRIPTION OF THE PREFERRED EMBODIMENTS

Figure 1:
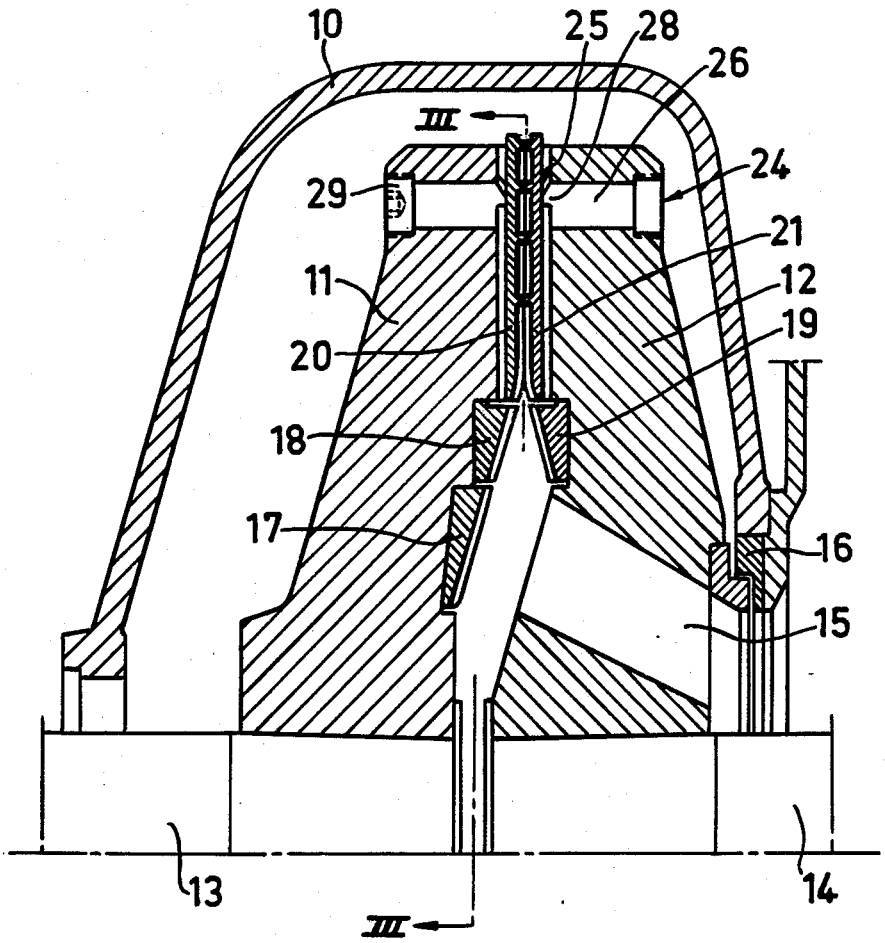
FIG. 1 is a cross-section through the upper halves of two opposite segment holders rotatable in opposed directions and with segments mounted thereon.
Figure 3:
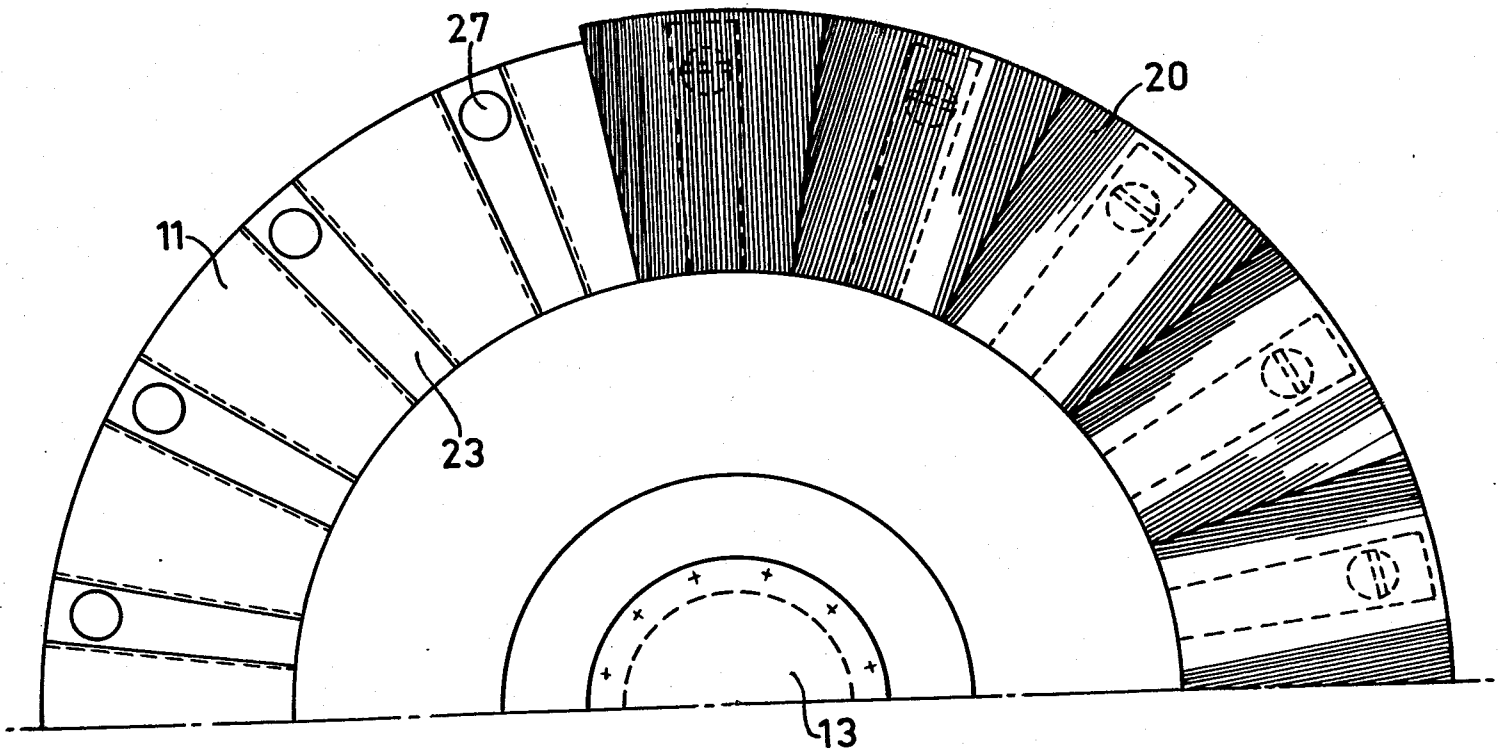
FIG. 3 is a projection of the upper half of a segment holder according to FIGS. 1 and 2, FIGS. 4–6 are three views of a refiner segment for the embodiment according to FIG. 1.

In FIGS. 1 and 2 a refiner housing 10 is shown which encloses two opposite disc-shaped carriers 11,12, each located on an axle 13,14. The opposed surfaces of the carriers are plane in FIG. 1 and conic in FIG. 2. The axles 13,14, and therewith the carriers 11,12, are rotatable in opposed directions. One carrier 12 is formed with apertures 15 for feeding the material to be refined into the intermediate space between the carriers. Outside the apertures 15 a sealing 16 is provided between the carrier 12 and refiner housing 10. On the surfaces of the carriers 11,12 facing toward each other, segments 17,18,19, which are provided with wings, are located for feeding the material outward. Radially outside thereof refiner segments 20,21 are located, which between themselves form a gap where the material to be refined during its outward passage is disintegrated to fibre pulp.

The refiner segments 20,21 are attached to the side of each other in a ring extending about each carrier 11,12. The segments are cast of a very hard material and provided on their front surface with bars and intermediate grooves for disintegrating and processing the material to be refined. Each carrier 11,12 is provided in an overall extending zone with radial dovetail grooves 23, the width of which decreases in radial inward direction. The segments 20,21 are provided on their rear surface with corresponding dovetail cams 22 fitting into the grooves 23. The width of the cams 22 decreases in radial inward direction as much as the width of the grooves 23, so that the segments 20,21 can be attached on the carriers 11,12 by pushing or pressing the segments so that their cams 22 engage with the grooves 23. Hereby a stable connection without clearance is brought about between the carrier and refiner segment.

In order to secure the segments 20,21 in their engaged positions, each segment is provided with an individual locking, which consist of locking members 24 located in the carriers 11,12 and co-operating with a corresponding recess 25 in the rear surface of the segments 20,21.

According to the embodiments shown in FIGS. 1–6, the locking member 24 is a piston or rod member 26, which is movable in a bore 27 in the carrier 11,12. The piston 26 is provided at its forward end with a shoulder 28, which hooks into the recess 25 formed in the cam 22 of the segment. The piston 26 is retained in its locking position by a threaded plug 29. At the exchange of segments, it is only necessary to move back the corresponding piston 26 whereafter the segment can be drawn out and a new segment be inserted.

Figure 7:
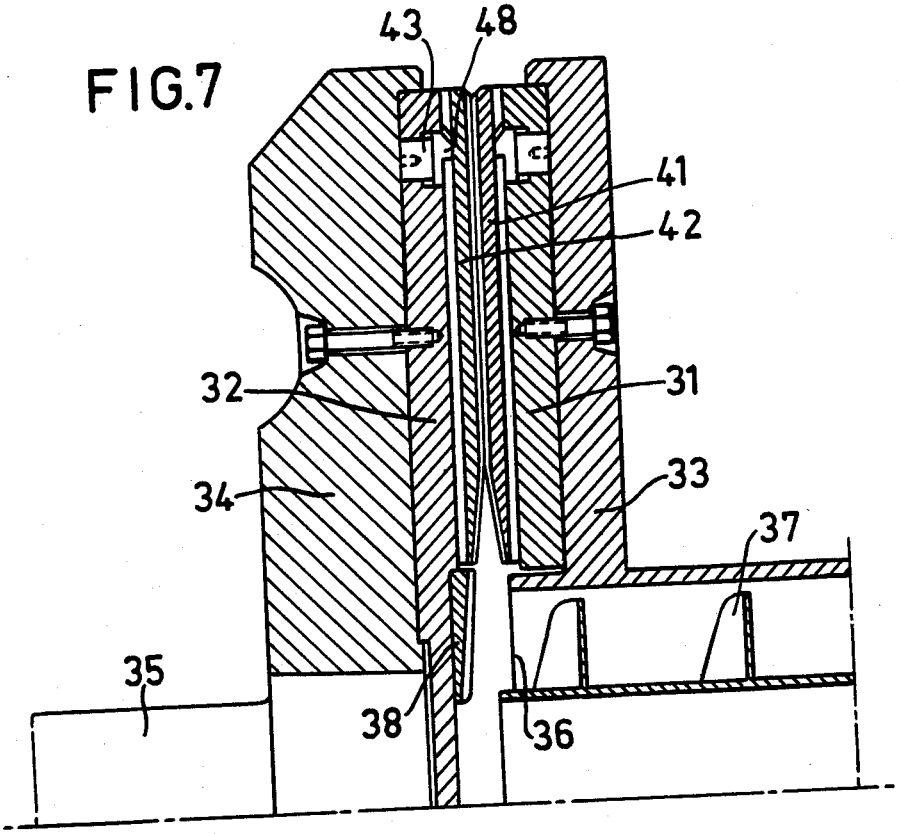
FIG. 7 is a cross-section through the upper halves of two opposite segment holders, one of which is stationary and the other one is rotary.

In FIGS. 7 and, respectively, 10 two embodiments are shown, at which one carrier 31 is stationary and the second carrier 32 is rotary. The carriers 31,32 are of disc shape and attached on a stator 33 and, respectively, a rotor 34, which latter is mounted on a rotary axle 35. The stator 33 is formed with a central opening 36 for feeding the material to be refined into the intermediate space between the carriers. Said feed is effected by a feed screw 37. On the surfaces of the carriers 31,32 facing toward each other segments 38,39,40 provided with wings are located for feeding and guiding the material outward. Radially outside these segments refiner segments 41,42 are located, which between themselves form a gap, in which the material during its outward passage is disintegrated to fibre pulp.

The refiner segments 41,42 are attached to the side of each other in a ring about each carrier 31,32. The carriers 31,32 in their turn are detachably attached on the stator 33 and, respectively, rotor 34. This implies, that at the exchange of refiner segments the entire carrier with its ring of segments rapidly can be replaced by a new one by moving apart the stator 33 and rotor 34. A corresponding arrangement, of course, could be utilized also at the embodiments shown in FIGS. 1–6.

The refiner segments 41,42 have in principle the same design as the aforesaid segments 20,21 and, thus, are attached on the carriers 31,32 by means of dovetail cams 22 and grooves and of locking members 24 as described above. At their radial side edges the segments can be provided with ridges 49, which rest against the carrier 31,32 and here transfer the refining pressure thereto.

Figure 8:
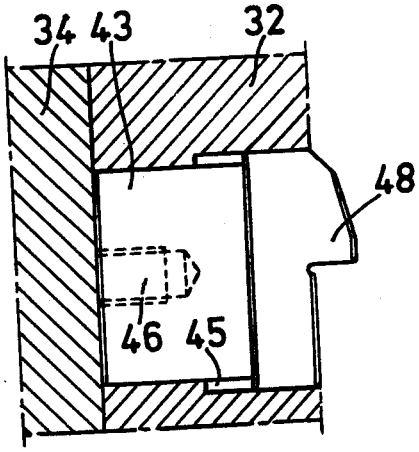
FIG. 8 shows the locking member in FIG. 7 on an enlarged scale.
Figure 9:
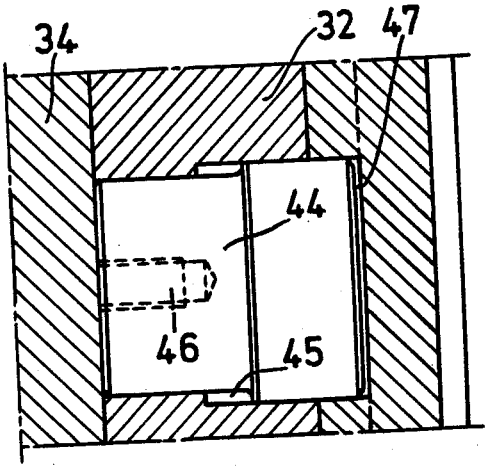
FIG. 9 shows an alternative to the locking member in FIG. 8.

According to FIGS. 7,8 and 9, the locking members 24 are formed as pistons 43,44, which are movable in bores 45 in each carrier 31,32. These bores extend transversely through the carrier 31,32, so that the pistons 43,44 are retained in locking position by the stator 33 and rotor 34 which are located behind. In order to facilitate the withdrawal of the pistons 43,44, a threaded bore 46 is provided in the rear surface of the pistons. The locking of the refiner segments 41,42 is effected by the forward portion of the pistons 43,44 which co-operate with a recess 47 in the segments. The forward portion of the piston 43 is formed with a shoulder 48, while the forward portion of the piston 44 is cylindric. The recesses 47 co-operating with the pistons 43,44 preferably are formed in the dovetail cam 22 on the rear surface of the refiner segments.

Figure 10:
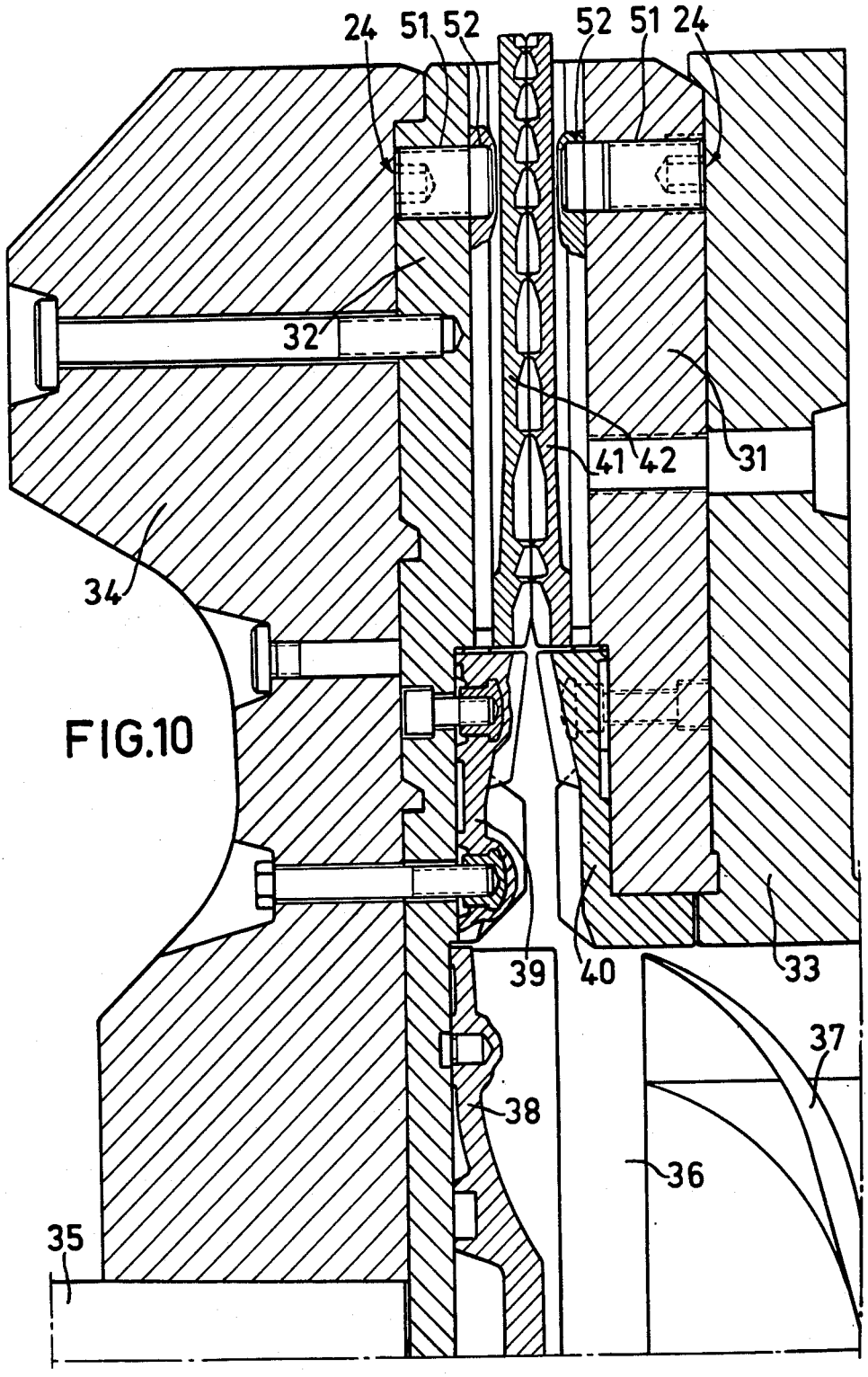
FIG. 10 shows an alternative embodiment of the device according to FIG. 7.
Figure 11:
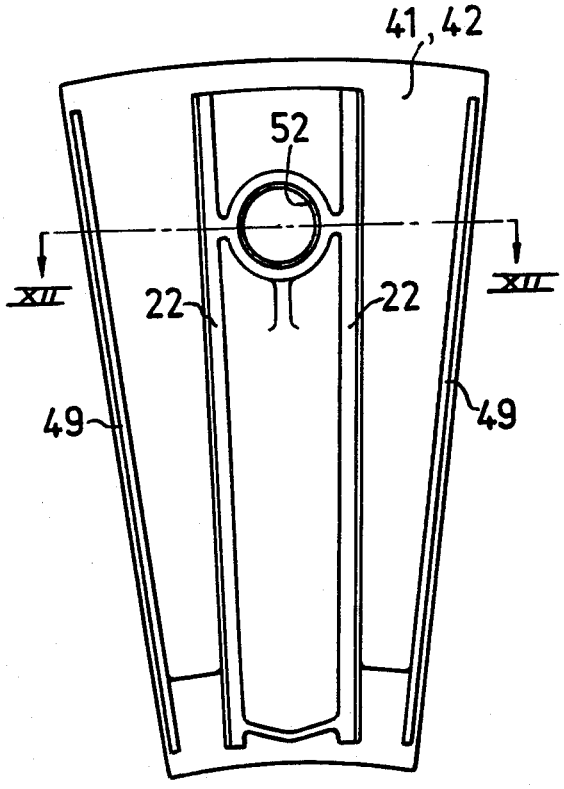
FIG. 11 shows the rear surface of a refiner segment for the embodiment according to FIG. 10.
Figure 12:
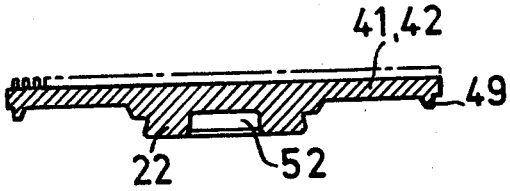
FIG. 12 is a section along the line XII—XII in FIG. 11.

According to the embodiment shown in FIG. 10, the locking members 24 proper are screwed into corresponding bores 51 in the carriers 31,32. The forward portion of the locking members has circular cross-section and is slightly conic. A recess in the rear surface of the refiner segments 41,42 is intended to co-operate with the locking member 24 and has been formed at the casting of the segment. Said recess 52 is utilized also at the manufacture of the segment where it is used for attaching the segment when the segment is given the desired dimensional accuracy, for example by grinding.

Also embodiments other than those described above can be imagined. Each refiner segment, for example, can be provided on the rear surface with several substantially radial cams for co-operation with corresponding grooves in the carrier. The locking members, further, can be designed so as to be movable in different ways, for example manually, pneumatically or hydraulically. The locking members may also be constructed spring-loaded. More than one ring of segments can be provided concentrically on the carrier.

The invention, thus, is not restricted to the embodiments shown and described, but can be varied within the scope of the invention idea.

What is claimed is:

1. A device for refining lignocellulose-containing material comprising a pair of carriers each of which is provided with refining members connected thereto, the refining members defining refining segments positioned in a ring about the carrier, rear sides of the refining segments and the carriers having facing surfaces provided with keyingly interengaging substantially radial cams and grooves, wherein the refiner segments are individually locked on the carriers by a separate movable locking rod member receivable in a bore defined in the carriers, the refiner segments provided with a recess on the rear sides substantially concentric with the bore, the rod member movable in said bore and engageable with the recess so as to lock the segments to the carriers.

2. A device as defined in claim 1, wherein the rod member is provided with a shoulder, cooperating with the recess formed in the cam of the refiner segment.

3. A device as defined in claim 1, wherein the locking rod member is threaded into the bore in the carriers and cooperates with a circular recess provided in the rear surface of the refiner segment.

4. A device as defined in claim 3, wherein the circular recess in the rear surface of the refiner segment is formed during the casting of the refiner segment.

5. A device as defined in claim 1, wherein the carriers are attached detachably on a stator and rotor, which are located behind the carriers and prevent the locking rod member from being moved out of the locking position.

* * * * *